US005725049A

United States Patent [19]

Swanson et al.

[11] Patent Number: 5,725,049

[45] Date of Patent: Mar. 10, 1998

[54] CAPILLARY PUMPED LOOP BODY HEAT EXCHANGER

[75] Inventors: Theodore D. Swanson, Columbia; Paul Wren, deceased, late of Severna Park, both of Md., by Patricia A. Wren, executrix

[73] Assignee: The United States of America as represented by the Administrator of the National Aeronautics and Space Administration, Washington, D.C.

[21] Appl. No.: 551,263

[22] Filed: Oct. 31, 1995

[51] Int. Cl.[6] ..... F28D 15/00

[52] U.S. Cl. ..... 165/104.26; 165/104.25; 122/366

[58] Field of Search ..... 165/104.26, 104.25, 165/46; 126/96, 45; 122/366

[56] References Cited

U.S. PATENT DOCUMENTS

| | | | |
|---|---|---|---|
| 3,738,702 | 6/1973 | Jacobs | 165/104.26 X |
| 3,901,311 | 8/1975 | Kosson et al. | 122/366 X |
| 4,602,679 | 7/1986 | Edelstein et al. | 165/104.26 |
| 4,765,396 | 8/1988 | Seidenberg | 165/104 |
| 4,807,447 | 2/1989 | Macdonald et al. | 165/46 |
| 4,883,116 | 11/1989 | Seidenberg et al. | 165/104 |
| 5,016,705 | 5/1991 | Bährle et al. | 165/104.26 X |
| 5,076,352 | 12/1991 | Rosenfeld et al. | 165/104.26 |
| 5,201,365 | 4/1993 | Siegal | 165/46 |
| 5,269,369 | 12/1993 | Faghri | 607/104 |
| 5,303,768 | 4/1994 | Alario et al. | 165/104.26 |
| 5,320,164 | 6/1994 | Szczesuil et al. | 165/46 |
| 5,386,823 | 2/1995 | Chen | 165/46 |

FOREIGN PATENT DOCUMENTS

| | | | |
|---|---|---|---|
| 2093981 | 9/1982 | United Kingdom | 165/46 |

OTHER PUBLICATIONS

*Overview of Capillary Pumped Loop Technology*, by Jentung Ku; 1993 National Heat Transfer Conference; Atlanta, Georgia; Aug. 8–11, 1993.

*Thermodynamic Aspects of Capillary Pumped Loop Operation*, by Jentung Ku; 6th AIAA/ASME Joint Thermophysics and Heat Transfer Conference; Colorado Springs, Colorado; Jun. 20–23, 1994.

*Design, Development and Test of a Capillary Pump Loop Heat Pipe*; by E. J. Kroliczek et al.; AIAA 19th Thermophysics Conference; Snowmass, Colorado; Jun. 25–28, 1984.

*Capillary Pumped Loop Application Guide*; by Brent A. Cullimore.

*Primary Examiner*—John Rivell
*Assistant Examiner*—Christopher Atkinson
*Attorney, Agent, or Firm*—Keith L. Dixon

[57] ABSTRACT

A capillary pumped loop for transferring heat from one body part to another body part, the capillary pumped loop comprising a capillary evaporator for vaporizing a liquid refrigerant by absorbing heat from a warm body part, a condenser for turning a vaporized refrigerant into a liquid by transferring heat from the vaporized liquid to a cool body part, a first tube section connecting an output port of the capillary evaporator to an input of the condenser, and a second tube section connecting an output of the condenser to an input port of the capillary evaporator. A wick may be provided within the condenser. A pump may be provided between the second tube section and the input port of the capillary evaporator. Additionally, an esternal heat source or heat sink may be utilized.

4 Claims, 4 Drawing Sheets

CAPILLARY PUMPED LOOP BODY HEAT EXCHANGER

ORIGIN OF THE INVENTION

The invention described herein was jointly made by an employee of the United States Government and a non-employee of the United States Government. This invention may be manufactured and used by or for the Government for governmental purposes without the payment of any royalties thereon or therefor.

TECHNICAL FIELD

The present invention relates to the art of heat exchange, and more specifically, to the use of a capillary pumped loop for equalizing body temperatures.

BACKGROUND ART

There are numerous instances where it is desirable to transfer heat from a region of excess heat generation to a region where there is too little heat. The object is to keep the region of heat generation, or heat accumulation, from getting too hot, or to keep the cooler region from getting too cold. This is a typical thermal engineering problem encountered in a wide range of applications ranging from building environmental conditioning systems to spacecraft thermal control systems to the human body.

A variety of techniques can be employed to achieve this heat sharing effect. These include heat straps, i.e., simple strips of high conductivity material, closed loops of pumped single phase fluid, heat pipes, mechanically pumped two-phase loops, and capillary pumped two-phase loops.

One prior art device includes a plurality of closed recirculating conduits extending from a turbo pump compressor rotary generator worn on a waist of an undergarment that is worn over the body of a person, wherein a heat exchanger is formed by interweaving the conduits carrying refrigerant fluid to various parts of the body to keep the person cool in summer and warm in winter.

Another prior art device includes flexible intercommunicating containers (such as coils) are incorporated in clothing or are applied directly to the body and are adapted to fit the body contour and function as heat removers by using water under a vacuum in the containers such that the water will boil at low temperatures to remove body heat as it turns into a vapor.

An additional prior art device utilizes fluid carrying tubes and provides both air and vapor permeability to promote convective heat transfer while also providing conductive heat transfer.

A further prior art device provides a large quantity of cooling air that is moved with significant perspiration evaporation velocity within a protective clothing ensemble.

A still further prior art device includes heat pipes which distribute energy to and from portions of the body to provide heating or cooling by redistributing body heat. The heat pipes are incorporated, for example, into a garment worn by a person, wherein the heat pipes incorporate a wick to move a condensed fluid from a condensing end, by capillary action, to an evaporating end where body heat is transferred to the fluid to cause evaporation of the fluid. The vapor then moves through the tube to the condensing end so that the heat can be removed, by cool body part, from the vapor to condense the fluid.

The most advanced and efficient concept is the capillary pumped loop (CPL). This capillary pumped loop technology has recently been developed for spacecraft applications due to its very low weight to heat transferred ration, high reliability, and inherent simplicity. The capillary pumped loop is a continuous loop in which both the vapor and the liquid always flow in the same direction.

A capillary pumped loop is a two-phase heat transfer system. Heat is absorbed by evaporation of a refrigerant at the evaporator section, transported via a vapor in tubing to a condenser section to be removed by condensation at the condenser. This phenomena makes use of a refrigerant's latent heat of vaporization/condensation, which permits the transfer of relatively large quantities of heat with small amounts of fluid and negligible temperature drops. A variety of refrigerants including ammonia, water, and several freons have been found to be suitable working fluids. The basic capillary pumped loop consists of an evaporator section with a capillary wick structure, of a pair of smooth wailed tubes (one of the tubes is for liquid, i.e., refrigerant, supply and the other is for vapor return) and a condenser section. In many applications the pressure head generated by the capillary wick structure provides sufficient force to circulate the refrigerant throughout the loop. In other applications, however, the pressure differential due to fluid frictional losses, static height differentials, or other forces may be too great to allow for proper heat transfer. In these situations it is desirable to include a mechanical pump to assist in fluid movement. Systems employing such pumps are called hybrid capillary pumped loops.

A capillary pumped loop is inherently simple in concept. A successful design, however, requires the judicious selection of a number of engineering design parameters. This is often complicated by the fact that many of these parameters are interrelated. Perhaps the most critical parameters are the wick design, selection of refrigerant, and, if present, design of the external pump. The wick must have very small but uniform pores in order to generate efficient capillary pumping. The capillary pumping head generated is inversely related to the pore size. However, as the pore size decreases, so does the wick's permeability. This causes an increase in resistance to flow. Accordingly, an optimum must be found for a given application. It is also critical that the wick material be compatible with its container and the operating fluid. Furthermore, it must not shrink, swell or shed particles. The wick must also be chemically and physically stable in its operating environment over long periods of time. This would include exposure to operating temperatures and temperatures involved in fabrication. The wick material must also be machinable. A wide variety of wicks have been used for capillary pumped loop and/or heat pipe applications. These have included metal extrusions, metal wire screens, sintered metals, natural fibers, ceramics, glass fibers, polymerics, and others. Each type of wick has its own set of advantages and disadvantages.

The specific refrigerant selected has a major impact on the performance of the capillary pumped loop. Firstly, the refrigerant must be suitable for operation within the temperature range of interest. Its freezing point should be below the normal minimum operating temperature and its critical point above the normal maximum operating temperature. It should have a high latent heat of vaporization, high surface tension, high density, and low liquid dynamic viscosity. The refrigerant must be chemically stable and not disassociate from repeated vaporization/condensation cycles. It must be chemically compatible with all materials with which it comes into contact. In order to maximize safety, the refrigerant should also have a low vapor pressure at both room and operating pressures, be nontoxic and non flammable. A wide variety of refrigerants have been employed in the past. Common examples include ammonia, water, various freons, methane and ethane.

Benjamin Seldenberg discloses a *Polymeric Heat Pipe Wick* in U.S. Pat. No. 4,765,396 and Benjamin Seidenberg et al. disclose a *Ceramic Heat Pipe Wick* in U.S. Pat. No. 4,883,116. These patents are incorporated into this specification by reference. Both of these heat pipe wicks are disclosed as being incorporated into an evaporator of a closed loop capillary pumped loop used in a crew's cabin, for example The capillary pumped loop transfers heat from one location where the evaporator is located to another location, wherein condensing of the vaporized refrigerant is performed.

Capillary pumped loops have been analyzed in several papers, which are incorporated into this specification by reference. Jentung Ku provided a paper on the *Overview of Capillary Pumped Loop Technology* at a 1993 National Heat Transfer Conference and a paper on the Thermodynamic Aspects of Capillary Pumped Loop Operation at the 1994 6th AIAA/ASME Joint Thermophysics and Heat Transfer Conference. E. J. Kroliczek et al. provided a paper on *Design, Development and Test of a Capillary Pump Loop Heat Pipe* at the 1984 AIAA 19th Thermophysics Conference.

Most current capillary pumped loop heat transfer loops do not employ a pump. For those applications where the static height differential is more than a few inches or the fluid flow dependent pressure drop is more than a few tenths of a psi, however, some sort of external pumping is necessary. This may be the case for applications relating to humans or animals in a normal, i.e., one gravity, environment. External pumps are also used to increase the capacity of the capillary pumped loop. When an external pump is combined with a capillary pumped loop the resulting device is called a hybrid pump. Two basic system configurations exist: series and bypass. In the series configuration the external pump is placed directly upstream of the capillary evaporator's liquid inlet. It may operate constantly or controlled in a known manner. In the bypass configuration, the capillary evaporator is located in the same place except that there is also a section of piping plumbed in parallel to it. In this mode, the pumped liquid will normally bypass the capillary evaporator (assuming that the pump is operating) unless heat is applied to it. When heated, the capillary evaporator is a self regulating device and will draw the required amount of refrigerant to absorb the heat by evaporation. In this configuration, the pump may or may not be controlled. As mentioned above, the pump is a critical design element. It must have the capacity to pump the required amount of fluid, have adequate longevity, and be chemically and physically compatible with the rest of the system. A variety of different types of pumps may be used. Current technology has focused almost entirely on the use of positive displacement gear pumps. Other types of mechanical or even non-mechanical pumps, however, could be used. Examples might include: centrifugal, screw, diaphragm, peristaltic, or non-contact electromagnetic. An external source of electricity is generally employed to drive the pump motor. However, an external mechanical source of energy may be used. In general, the pump provides a continuous and even flow rate. The pump will also generally require some sort of controller. This may be as simple as a basic on/off device, be heat load demand based, or involve a more elaborate feedback loop. The type of pump/controller combination employed will depend upon the application.

A paper by Brent A. Cullimore entitled Capillary *Pumped Loop Application Guide* discusses capillary pumped loops and hybrid capillary pumped loops. Hybrid capillary pumped loops incorporate a mechanical pump in series with the loop to provide fluid to the evaporator, and a by-pass line placed in parallel with the pump when using an uncontrolled pump to enable capillary pumped loop mode operation.

A variety of methods have been applied in an attempt to keep body parts warm when exposed to cold. Insulation, in the form of clothing, has of course been the traditional solution. More recent solutions based on modern technology have included battery powered electric heaters and chemically based heaters. All of these approaches have limitations. Insulation merely retards heat loss, may restrict movement, and may loose its effectiveness when wet. Batteries are heavy and have a very limited lifetime. Chemically based heaters also have a short lifetime and may also pose some safety concerns.

Cooling body parts that get too warm is the complimentary problem to warming those that get too cold. Variations of the technology employed for this problem could also be used for the more general problem of heat sharing. For example, astronauts and workers who are exposed to high temperatures (or are insulated from their environment such that their bodies tend to overheat) may wear a special garment that has tubes filled with cold water sewn into it. The cold water picks up excess body heat and then rejects it to an ice pack or other cold storage media. This same basic concept could also be used in a heat sharing mode to warm cold body parts by absorbing excess heat from warmer body parts, transporting it in the water loop to the colder parts, and then rejecting it to such colder parts to warm them. Alternatively, this approach could serve to keep the warmer body parts from overheating. While this solution is workable, it has several serious problems. The water lines, pump, power source and water itself are all heavy and awkward to carry. In addition, a significant amount of power is required to circulate the water. This implies either short lived batteries or connection to an external power source with consequent mobility restrictions. A CPL could perform the loop heat transfer function.

Statement of the Invention

Accordingly, it is an object of the present invention to provide a capillary pumped loop heat transfer loop suitable for application to the human body.

It is also an object of the present invention to provide a device which would provide for the warming of areas which tend to get cold (e.g., feet, hands, ears, face, etc.) by transferring excess heat from warmer areas (e.g., behind the knee or elbow, armpit groin, trunk, etc.). This effect may be accomplished with or without the assistance of an external pump.

An additional object of the present invention is to provide a simple and self contained capillary pumped loop based heat transfer loop which is safe to apply to the human body or to animals.

It is another object of the present invention to provide a capillary pumped loop which could be used in a heat sharing mode to either warm cool body areas by excess heat collected and transported from hot body areas, and/or cool hot body areas by rejecting excess heat to colder areas.

Yet another object of the present invention is to provide a simple and safe device to collect excess body heat and transport it to a location where it might be rejected to an external sink such as a cold pack or radiator.

A further object of the present invention is to provide a device which can provide supplemental heat from an external source (such as electric heaters).

These and other objects can be achieved according to the principles of the present invention wherein a capillary pumped loop for transferring heat from one body part to another body part comprises a capillary evaporator for vaporizing a liquid refrigerant by absorbing heat from a heat source, such as warm body part, a condenser for turning a vaporized refrigerant into a liquid by transferring heat from the vaporized liquid to a cool body part, a first tube section connecting an output port of the capillary evaporator to an input of the condenser, and a second tube section connecting an output of the condenser to an input port of the capillary evaporator.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

In the following detailed description, many specific details are set forth to provide a more thorough understanding of the present invention. It will be apparent, however, to those skilled in the art, that the present invention may be practiced without these specific details.

DETAILED DESCRIPTION OF THE PREFERRED EMBODIMENTS

Figure 1:
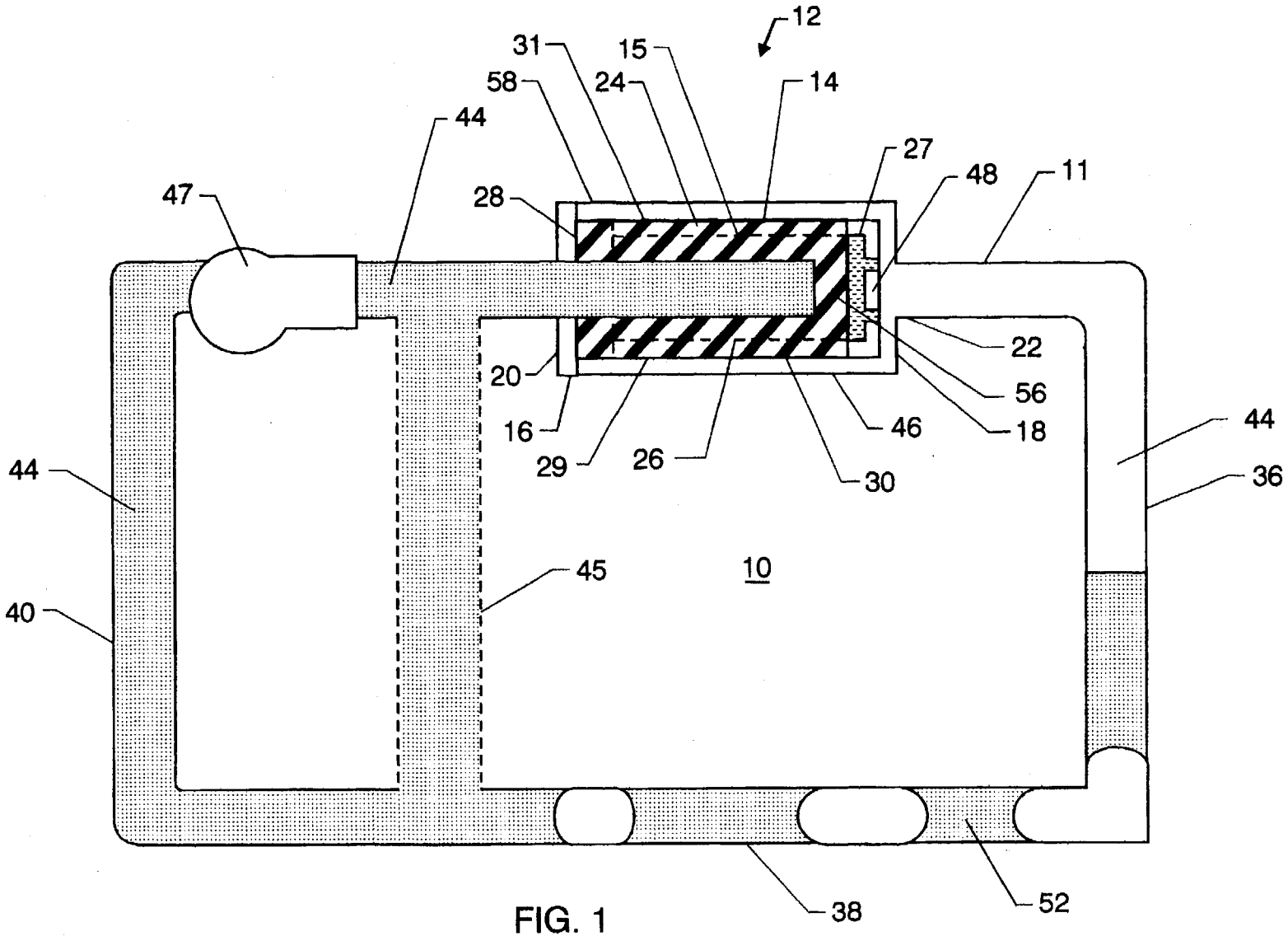
FIG. 1 illustrates a full cut-away view of a capillary pumped loop taken through a plane which includes the central axes of the evaporator, condenser, and tubing. The dotted lines indicate an alternative configuration with a mechanical pump and a bypass line.

Referring to FIG. 1, wherein like reference numerals and characters designate identical or corresponding parts, a capillary pumped loop 10 includes a hollow tube 11 which extends around the entire loop except for a capillary evaporator generally indicated by 12, a condenser zone 38, and, if present, a pump 47. Tube 11 is preferably cylindrical in shape, but not necessarily so. It is important to recognize that tube 11 does not contain a wick of any kind. Capillary evaporator 12 contains a wick 24. Portions of an outer surface 29 of wick 24 are in tight thermal contact with an inner wall 30 of an evaporator housing 58. Evaporator 12 is bound at its ends by walls 16 and 18 which may be either and integral part of evaporator 12 or secured thereto in a conventional way. Wall 16 has a round, centrally located liquid inlet port 20 for liquid entry and wall 18 has a round, centrally located vapor outlet port 22 for vapor outlet. Vapor port 22 is generally somewhat larger than liquid port 20. Evaporator 12, as well as walls 16 and 18, may be made of any non-porous material, either metal or non-metal, that meets appropriate strength, materials compatibility, and thermal conductivity requirements.

Wick 24 is centrally located within evaporator 12. Wick 24 has a central bore 26 extending almost all the way through its length between an open end 28 which is adjacent liquid port 20 and a closed end 56 near vapor outlet 22. A cylindrical evaporator 12 is shown here. However it is possible to have a flat evaporator 210, discussed later with regard to FIGS. 2–4B, with multiple parallel channels 370 bored within wick 24. It is also possible to have multiple parallel evaporators 12 of a cylindrical shape connected to common liquid inlet and vapor outlet headers. When heat is applied to outer housing 58 of evaporator 12 it is absorbed by refrigerant 44. Refrigerant 44 is thus vaporized. Some sort of channels 31 must be provided either along outer surface 29 of wick 24 or evaporator housing inner surface 30 to accommodate vapor. Such channels would run longitudinally along wick 24 or housing 30 but must not extend to wall 16. Channels 31 in FIG. 1 depict multiple parallel channels bored within wick 24. A vapor space is formed between wick 24 and inner wall 30 of evaporator housing 30 with a stand off pedestal 27 to ensure that vapor can escape through exit 48 to vapor port 22.

Wick 24 generates a capillary pumping action when heat is applied and vaporizes refrigerant 44. Heat to be removed form a heat source, not illustrated, is applied directly to outer surface 46 of evaporator housing 58. Heat is thus absorbed and transferred, by conduction, to inner surface 30 of evaporator housing 58. This is in contact with refrigerant 44. Liquid refrigerant 44 absorbs heat via vaporization. Liquid refrigerant 44 is drawn through pores (not shown) in wick 24 by fluid surface tension to an outer surface of wick 24 thus forming a meniscus. In the presence of heat, refrigerant 44 evaporates from the surface of wick 24 in an isothermal process, and is replenished by continuous capillary action through wick 24.

The area of wick 24 between bore 26 and inner wall 30 is made of a porous material such as metal screening, ceramic foam, polyethylene, organic or non-organic fibers or sintered metal. It is very important that whatever material wick 24 is made of be physically and chemically compatible with refrigerant 44. In addition, wick 24 must not decompose or otherwise degrade from the vaporization process or over time. Wick 24 must also have a uniform porosity. The smaller the porosity the greater the capillary pumping action. A one micron pore size could provide a 140 inch static height for refrigerant 44. Further, the wick material should be machinable so that it can be formed to fit into evaporator housing 58.

Section 36 of tube 11 is used to carry the vapor from port 22 to condenser section 38. Section 36 does not contain a wick, and may be made of metal or any other suitable material. In addition it may be straight, bent, contain a flexible joint, or be made of a flexible material. Section 36 is made of a material that is compatible with the operating fluid and environment.

Section 36 is connected to condenser section 38. Condenser section 38 may be either a single continuous tubing or a group of parallel tubes with common inlet and outlet manifolds. Design of this condenser section 38 is dependent upon the application. Should parallel passage be employed it is important that each parallel segment impose an equal pressure drop. Tubes 11 may be circular, rectangular, or some other shape. They may be either wicked or non-wicked. Condenser section 38 may be made of any material (metal or non-metal) which is compatible with refrigerant 44 and the operating environment.

Condenser section 38 condenses vaporized refrigerant 44 into a liquid 52. An outlet of condenser section 38 is connected to another section 40 of tube 11, which is similar to section 36 except that section 40 carries liquid refrigerant 44. Tube section 40 is typically of smaller diameter than tube section 36 and likewise has no wick. It may be straight, bent, contain a flexible joint, or be made of a flexible material. It is made of any material that is compatible with refrigerant 44 and the operating environment.

An external pump 47 may be necessary or desirable to overcome frictional pressure losses or static height differences. Optionally, pump 47 would not be used. An inlet to pump 47 is connected to an outlet of tube section 40. Pump 47 may be of a mechanical or nonmechanical design. If mechanical, it may employ gears, diaphragms, screws, blades, or other devices to pump the liquid. Non-mechanical pumps may also be employed. It is important that pump 47 be either self priming or always have a sufficient supply of liquid at its inlet. Pump 47 may be powered by electricity (not shown) from batteries or an external power supply. It may also be powered by an external mechanical force (not shown). For example, a body movement may be used to provide the motive force to power a diaphragm based mechanical pump. Additionally, some sort of control may be provided for pump 47. This control (not shown) may be a simple on/off manual control or a more complicated device involving sensors and feedback. Pump 47 must be made of materials that are compatible with refrigerant 44 and the operating environment.

For some applications it is desirable to provide a bypass tube 45 connected between the outlet of pump 47 and the outlet of condenser section 38. This line could be similar in construction to tube section 40 or be slightly smaller than tube section 40. If it is present, control of pump 47 may be simplified. Pump 47 can be left on continuously and liquid will circulate continuously from pump 47, through bypass tube 45, then through tube section 40, and then back into pump 47. Capillary evaporator 12 will automatically draw in only the required amount of liquid refrigerant 44 needed to meet the heat load. The disadvantage of this alternate system layout is that the pressure head of pump 47 is no longer available to overcome pressure differentials between capillary evaporator 12 and condenser section 38.

Heat to be removed from a body part is applied directly to an outer surface 46 of housing 58 of evaporator 12. Outer surface 58 may be designed to enhance heat transfer. Heat is absorbed at this location, conducted through the wall of housing 58, and then conducted to the surface of inner wall 30 of housing 58 of evaporator 12. This heat is then absorbed by evaporation of refrigerant 44. Vapor molecules, not illustrated, will form on fins 14 and grooves 15 of wick 24. From here they will migrate to channels 31. These channels are manifolded together at exit 48 of evaporator 12. Vaporized refrigerant 44 then enters tube 36 via vapor port 22.

Capillary action in wick 24 provides a pressure differential which pumps liquid through loop 10. The pressure head between the liquid and vapor phases of refrigerant 44 also provides a separation between the liquid and the vapor. Pump 47 provides an assist to this capillary pressure head.

Condenser section 38 is disposed to be adjacent to that part of the body that needs to be warmed. The walls of condenser section 38 are thus at a lower temperature than the saturation temperature of refrigerant 44. Vaporized refrigerant 44 then condenses, thus giving up heat to the cold body part and warming it. The now liquid refrigerant 44 then returns to capillary evaporator 12 by capillary pressure or a combination of capillary and mechanical pump pressure. The cycle then repeats.

Figure 2:
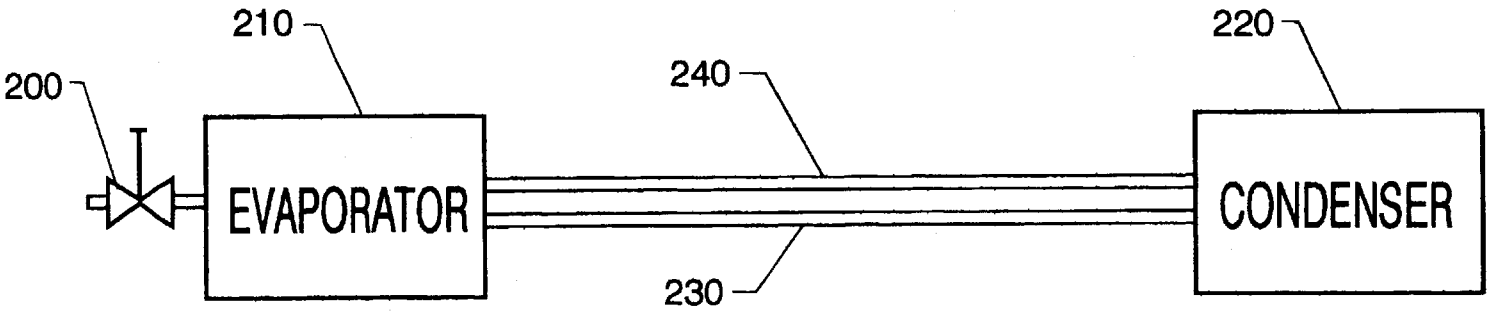
FIG. 2 illustrates an overall view of a capillary pumped loop of a second embodiment.

Referring to FIGS. 2–4B, there is shown a second embodiment of a capillary pumped loop. FIG. 2 illustrates the overall capillary pumped loop of the second embodiment. An evaporator 210 has a valve 200 provided to allow the system to be charged or purged of fluid, wherein valve 200 could be connected to a reservoir (not shown). Evaporator 210 will absorb heat from a body portion to evaporate a refrigerant and thus output a vapor to a condenser 220 via vapor tube 230. Condenser 220, located at another body part which is typically cooler than the body part where evaporator 210 is located, will provide heat from the vapor to the cool body part thus condensing the refrigerant into a liquid. The liquid refrigerant will cycle back to evaporator 210 via a liquid tube 240. In this embodiment, vapor tube 230 is preferably a flexible polyethylene or teflon tube of approximately ⅛" diameter, and liquid tube 240 is preferably a flexible polyethylene or teflon tube of approximately 1/16" diameter. Tubes 230 and 240 may be approximately 20" in length, and covered and separated by a thin insulation.

Figure 3A:
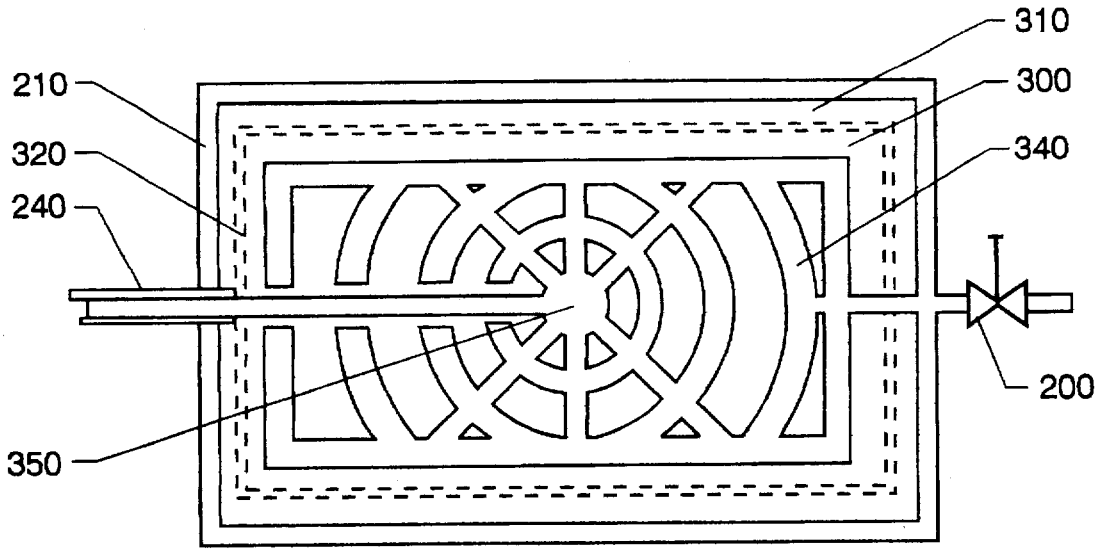
FIGS. 3A–3C illustrate different views of the evaporator utilized in the embodiment of FIG. 2.
Figure 3B:
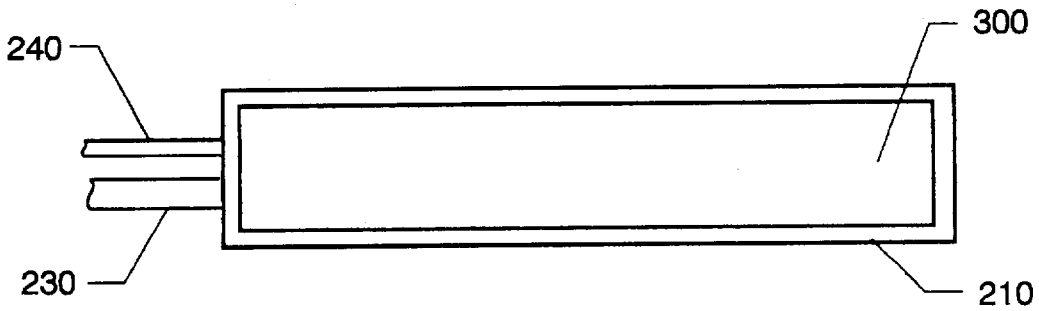
Figure 3C:
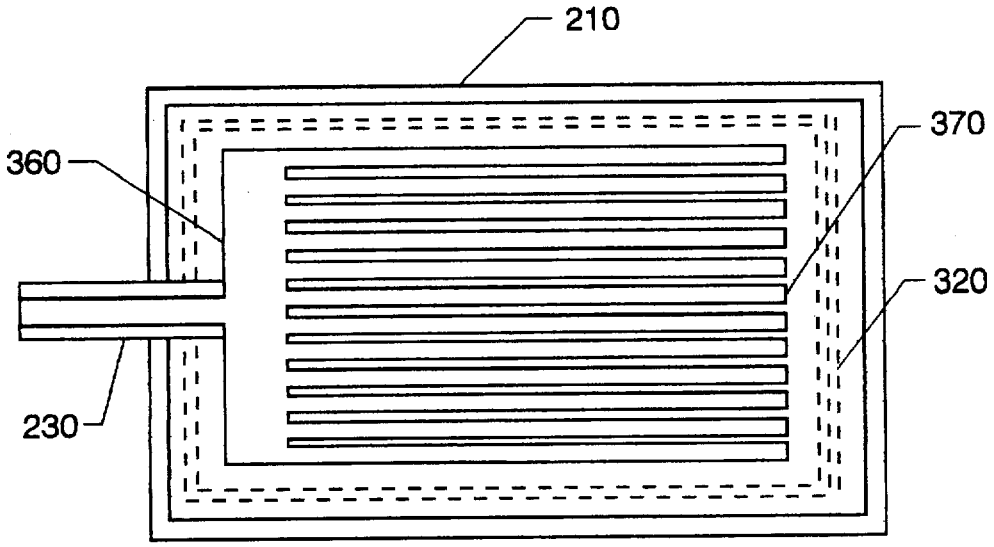

FIGS. 3A–3C illustrate a possible arrangement of evaporator 210. The housing for evaporator 210 can be a rectangular boxed shape housing approximately 3" by 2" by ½" in length, width and height, respectively, formed of approximately 1/16" thick solid plastic, such as a polyvinyl chloride. The walls, top and bottom of the evaporator housing may be formed from approximately 1/16" thick solid polyethylene, dose-cell, thermoplastic foam, the edges of which are sealed by glue or heat. Alternatively, the walls, top and bottom of the evaporator housing may be formed of approximately 1/16" thick rigid polyvinyl chloride sealed all around with a 1/16" thick layer of solid polyethylene, close-cell, thermoplastic foam. The exact material used are not as important as long as they are compatible with the refrigerant and the operating environment.

FIG. 3A depicts a top view of the liquid feed side of evaporator 210 comprising a wick having a small and uniform (typically 10 micron or less) pore size solid polyethylene, open-cell, thermoplastic foam, i.e., POREX®, core 300. Core 300 is connected to the housing of evaporator 210 by an approximately 1/16" to ⅛" solid perimeter layer of solid polyethylene, closed-cell, thermoplastic foam 310 heat or glue sealed 320 to the small micron core. Core 300 has a pattern of liquid feeder grooves 340 cut or formed into the top of core 300. Grooves 340 are approximately 1/16" wide by ⅛" deep and lain out in a circular star or webbed shaped pattern for dispersing refrigerant from a central liquid reservoir 350, which is connected to liquid tube 240, throughout the top portion of the small micron pore size core. The portions of the small micron pore size core 300 not removed by the formation of grooves 340 are in direct contact with the inside surface of the top portion of the evaporator housing. Note that the outer surface of the evaporator housing may be designed to enhance heat transfer.

FIG. 3B depicts a side view of evaporator 210 wherein liquid tube 240 is connected to the top or liquid feed side of evaporator 210, and vapor tube 230 is connected to the bottom or vapor side of evaporator 210. Core 300 has a thickness of approximately ⅜".

FIG. 3C depicts a bottom view of the vapor side of evaporator 210 having a plurality of parallel grooves 370 spaced approximately 1/16" apart, wherein these grooves 370 are approximately 1/16" wide by approximately 1/16" deep, cut or formed into the bottom of core 300. Grooves 370 are parallel connected to a common vapor header 360 which is a groove cut or formed to be approximately ⅛" wide by ⅛" deep in core 300. Header 360 provides vapor to vapor tube 230.

Figure 4A:
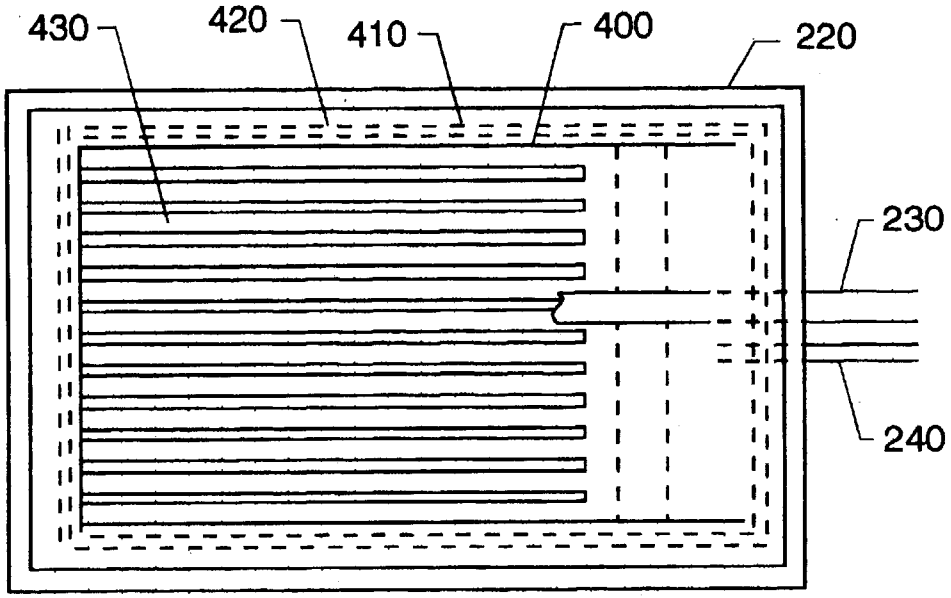
FIGS. 4A–4B illustrate different views of the condenser utilized in the embodiment of FIG. 2.
Figure 4B:
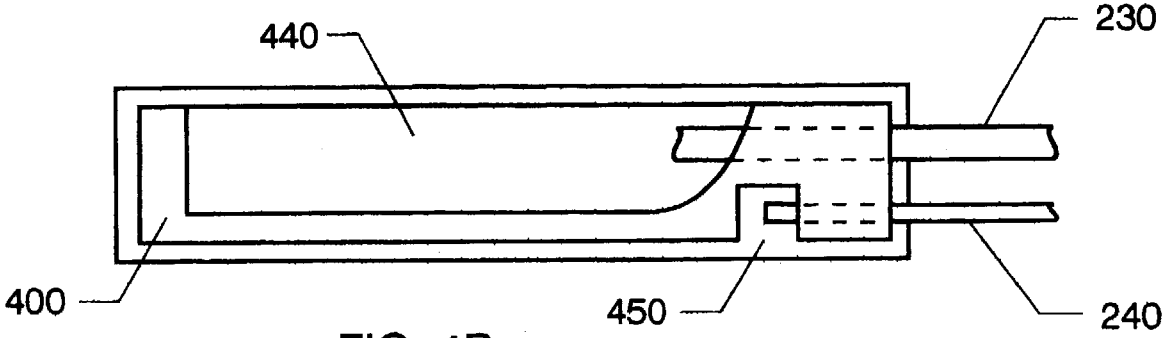

FIGS. 4A–4B illustrate a possible arrangement of condenser 220. The housing for condenser 220 can be a rectangular boxed shape housing approximately 3" by 2" by ⅜" in length, width and height, respectively, formed of approximately 1/16 thick solid plastic such as a polyvinyl chloride. The condenser housing is sealed all around with a 1/16" thick layer of solid polyethylene, close-cell, thermoplastic foam. Note that the outer surface of the condenser housing may be designed to enhance heat transfer.

FIG. 4A depicts a top view of condenser 220 which has a collector wick comprising a core 400 of small (approximately 10 microns) pore size glued or heat sealed 420 to a perimeter layer of a solid polyethylene, close-cell, thermoplastic foam 410. Vapor is supplied to condenser 220 via vapor tube 230, condensed to a liquid, and then the liquid is fed back to liquid tube 240 via parallel capillary grooves 430. Parallel capillary grooves 430, approximately 1/16" deep by 1/16" wide are formed in core 400.

FIG. 4B shows the formation of core 400 from a side view of condenser 220. A header portion 440 is formed by scalloping out an area approximately 3/16" thick by 2" long by 1½" wide from the approximately ¼" thick core leaving an approximate ¼" wide perimeter portion of the wick, and an approximate 1/16" thick bottom portion of core 400 in which grooves 430 are formed. Vapor line 230 is fed through one side of the perimeter portion of the wick and extends into header portion 440. A liquid header 450 is formed as a groove, approximately ⅛" wide by 1/16" high, in a bottom portion of one side of the perimeter portion of core 400 and extends for a length of approximately 1½" in parallel with the side of condenser 220 through which vapor tube 230 and liquid tube 240 extend. Header 450 provides a common collection point for receipt of the liquid provided by capillary grooves 430. Liquid tube 240 supplies the liquid collected in header 450 back to evaporator 210.

While there have been illustrated and described what are considered to be preferred embodiments of the present invention, it will be understood by those skilled in the art that various changes and modifications may be made, and equivalents may be substituted for elements thereof without departing from the true scope of the present invention. For example, it would be possible to include some sort of thermal storage mass, perhaps a phase change material such as a wax or even ice. If you wanted to provide heat to a body part, the thermal storage mass would be located integral with or near the evaporator. If you wanted to absorb heat from a body part, the thermal storage mass would be located integral to or near the condenser. Also, it would be possible to reject heat externally or absorb it from another source. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A capillary pumped loop for transferring heat from one body part to another body part, said capillary pumped loop including:

capillary evaporator means for vaporizing a liquid refrigerant into liquid by transferring heat wherein said capillary evaporator means includes a wick having a pattern of liquid feeder grooves for promoting even fluid distribution, said grooves formed in a top portion of said wick;

condenser means for turning a vaporized liquid refrigerant into a liquid by transferring heat from said vaporized liquid;

a first tube section connecting an output port of said capillary evaporator means to an input of said condenser means;

a second tube connecting an output of said condenser means to an input port of said capillary evaporator means; and said liquid feeder grooves including a central liquid reservoir connected to said second tube section for receipt of said liquid refrigerant;

said wick further having a plurality of parallel grooves formed in a bottom portion of said wick with each of said grooves connected in parallel fashion to a common vapor header which is connected to said first tube section and formed in said bottom of said wick.

2. The capillary pumped loop as set forth in claim 1, said wick being comprised of a polyethylene, open-cell, thermoplastic foam.

3. The capillary pumped loop as set forth in claim 1, said capillary evaporator means including a manually operable valve connected to at least one of said feeder grooves;

said valve being operable to charge said capillary evaporator means with said liquid refrigerant or to purge said capillary evaporator means of said liquid refrigerant.

4. The capillary pumped loop as set forth in claim 1, said pattern having one of a circular star shape and a web shape.

* * * * *